United States Patent [19]

Uhrman

[11] 4,135,261

[45] Jan. 23, 1979

[54] FLOATABLE DEODORANT HOLDER

[75] Inventor: Harold Uhrman, Pepper Pike, Ohio

[73] Assignee: The State Chemical Manufacturing Company, Cleveland, Ohio

[21] Appl. No.: 852,564

[22] Filed: Nov. 17, 1977

[51] Int. Cl.[2] ..... E03D 9/00

[52] U.S. Cl. ..... 4/222; 4/309

[58] Field of Search ..... 4/222, 309, 231, 294, 4/227, 228

[56] References Cited

U.S. PATENT DOCUMENTS

| | | | |
|---|---|---|---|
| 877,309 | 1/1908 | Emerson | 4/309 |
| 3,202,322 | 8/1965 | Cleary et al. | 4/222 |
| 3,597,772 | 8/1971 | Leavitt et al. | 4/222 |
| 3,824,633 | 7/1974 | Van Vlahakis | 4/222 |

*Primary Examiner*—Richard E. Aegerter
*Assistant Examiner*—L. Footland
*Attorney, Agent, or Firm*—Woodling, Krost, Granger & Rust

[57] ABSTRACT

A block of water soluble deodorant in a holder held substantially above the level of a body of water in a urinal or the like by a buoyant member supporting the holder and block.

8 Claims, 4 Drawing Figures

FLOATABLE DEODORANT HOLDER

This invention is directed toward floatingly supporting, in a body of water such as a body of water residing in the lower part of a urinal or the like, a block of deodorant material or the like in a holder by a buoyant member secured to the underside of the holder.

My invention is particularly adapted for use in a urinal of the type in which a substantial body of water is normally contained in the lower portion of the urinal. My invention may be utilized in the case of a block of solid water-soluble deodorant material to be buoyantly supported at or above the surface of the water contained in a device.

An object of my invention is to limit the erosion through solubility of a solid block of water-soluble deodorant in a body of water such as the water residing in the lower portion of a urinal or the like formed normally to contain such a body of water.

Another object is to conserve and prolong the period of the useful life of a block of deodorant of similar material by means for floating the block substantially at or above the surface of the body of water.

Other objects and a fuller understanding of this invention may be had by referring to the following description and claims, taken in conjunction with the accompanying drawings in which:

Figure 1:
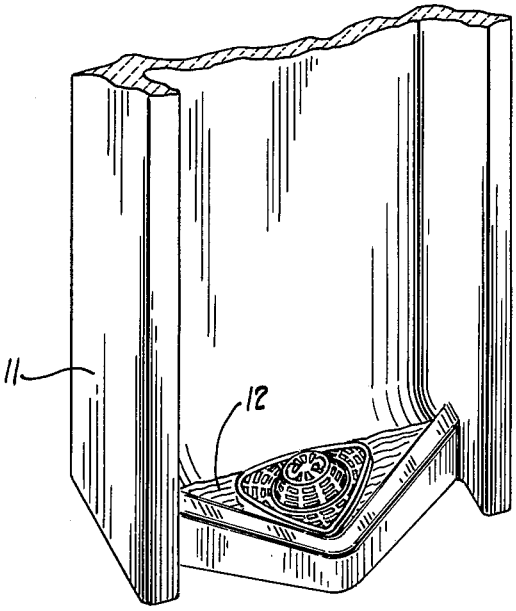
FIG. 1 is a perspective view of the lower portion of a urinal normally containing a body of water in the lowermost portion thereof, upon which body of water the improved device embodying my invention is floatingly supported.
Figure 2:
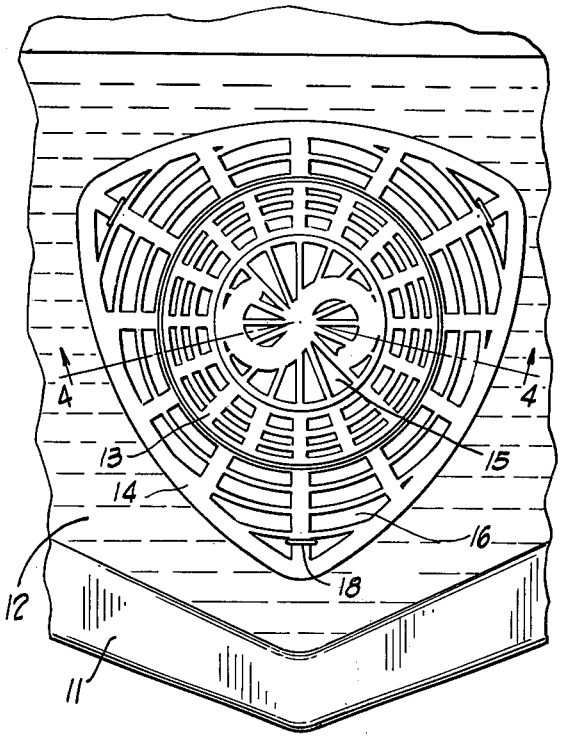
FIG. 2 is a plan view looking down on my improved device floating on a body of water in the lowermost portion of a urinal.
Figure 3:
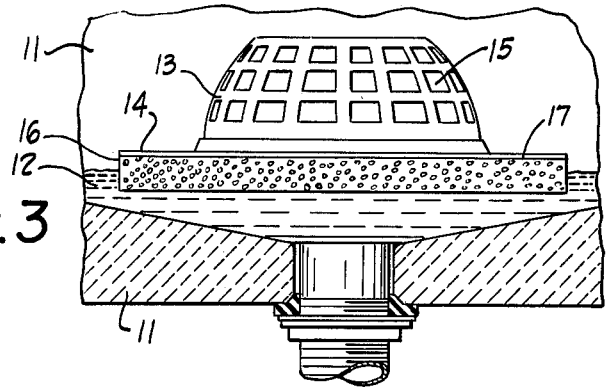
FIG. 3 is a side view of my improved device floating on a body of water in a urinal, shown partially in section.
Figure 4:
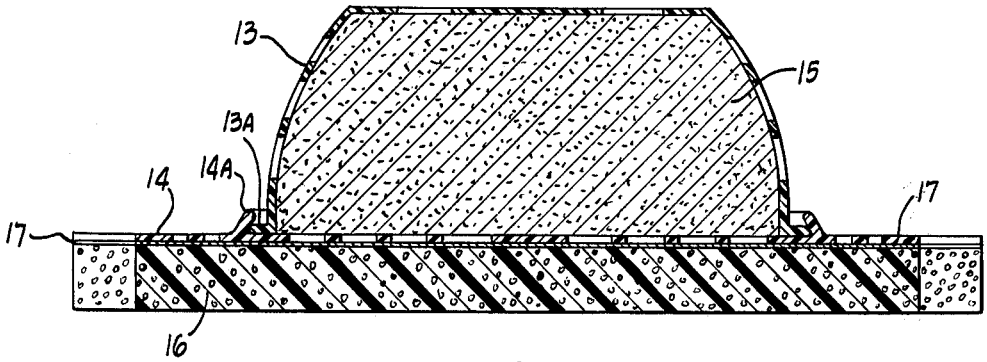
FIG. 4 is a sectional view, taken through the line 4—4 of FIG. 2, of my improved device.

In the drawing, the reference character 11 indicates a urinal. The urinal 11 is of the type which normally holds a body of water in the lowermost portion thereof. This body of water may be on the order of a few inches in depth. The urinal is supplied with the usual drain and flushing means.

Between flushes the body of water indicated by the reference character 12 stands in the lowermost part of the interior of the urinal as indicated in the drawing.

It has been usual to have a block of solid deodorant held in an open lattice work structure of plastic resting on the bottom of the urinal. Examples of such blocks of water soluble deodorant in plastic holders resting upon the bottom surface of a urinal are shown in U.S. Pat. No. 3,597,772; No. 3,760,429; and No. 3,824,633. However, some urinals are so designed and constructed that a body of water of some depth normally is held in the lowermost portion of the urinal.

In the case of urinals holding a body of water in the lower part of the urinal, then such block of deodorant in a holder resting on the bottom surface of the urinal, such as in the above identified patents, is quickly eroded away by being dissolved in the body of water around and above it. The block is thus early wasted away and does not last and persevere for a sufficient and appreciable period of time for economy and efficiency.

I have overcome the shortcomings of those prior arrangements by providing a novel means for floating the deodorant so as to be substantially at or above the surface of the water.

In the drawing illustrating a preferred form of my invention, the water soluble solid block of deodorant is denoted by the reference character 15. It may be one of any preferred compositions, all of which are well known in the industry and disclosed in the prior patents and literature.

The holder of molded plastic, made up of a central dome-shaped portion 13 and broad base portion 14, encloses the block 15. The holder is of open lattice construction offering many scattered openings through which the block 15 within is exposed. Examples of such holders are found in the prior art, such as in the above listed patents. The portions 13 and 14 are held together as a unit by the lower lip 13A of the portion 13 being held below the inner flanged over-hang 14A of the portion 14, the lip 13A and over-hang 14A being sufficiently yieldable as to permit the insertion of 13A under 14A.

To buoy up the plastic holder (13,14) containing the block 15, I secure a buoyant member 16 to the lower side of the base portion 14 of the holder. The shape and size of the buoyant member 16 coincides with that of the base portion 14 whereby the roughly triangular shapes of the base portion 14 and buoyant member 16 are congruent.

The buoyant member is foam or expanded plastic and may be made of an expanded plastic made up, for example, of the group of plastics known as polystyrene, polyethylene and polyurethene. It is less dense than water and is such as to readily float on water and to support on or above the surface of the water the block 15 and plastic holder (13,14).

To secure the buoyant member 16 to the base portion 14 I preferably employ a water insoluble adhesive 17 sandwiched as a film or layer between the base portion 14 and buoyant member 16. Being water insoluble, the adhesive layer continues to securely hold the holder and buoyant member together even though exposed to water. The water insoluble adhesive may be one of a number of readily available adhesives made for exposure to water without loss of holding power, and may include rubber-based adhesives, latex-based adhesives, and synthetic adhesives sold under different trade names.

In some instances, as an alternative to the employment of adhesive 17 for securing the base portion 14 to buoyant member 16, or as an additional means of securing them together, I also employ metal staples 18 to secure the base portion 14 to the buoyant member. The staples 18, three in number, are fastened to the base portion as shown and penetrate the body of the buoyant member 16 sufficiently to firmly hold them together.

My improved device as described holds a solid block of deodorant in a holder floating on the body of water so as to limit the degree of dissolution of the block by the water.

The present disclosure includes that contained in the appended claims, as well as that of the foregoing description.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A floatable deodorant holder adapted to float upon a body of water residing in a urinal or the like comprising a holder including a base portion and a receptacle portion positioned over the base portion, the receptacle portion having open spaces therein for exposing a block of deodorant or the like held in the receptacle portion above the surface of the water, a block of water soluble deodorant or the like held in the receptacle portion of said holder, and a buoyant member of expanded plastic of such buoyancy as to support said holder and block on said water to hold a substantial portion of the block above the surface of said water, said buoyant member being positioned beneath, and being secured to, the base portion of said holder so as to maintain the receptacle portion of the holder and block held therein above said buoyant member, the block being suspended substantially at or above the surface of the water to limit dissolution of the block in the body of water.

2. A floatable deodorant holder as claimed in claim 1 and in which the holder and buoyant member are secured together by a water insoluble adhesive bonding a bottom surface of the holder to a top surface of the buoyant member.

3. A floatable deodorant holder as claimed in claim 1 and in which the holder and buoyant member are stapled together to hold the holder and block therein above the buoyant member.

4. The combination of a block of water soluble deodorant or the like for use in a urinal or the like, a holder including a receptacle enclosing said block and a flat base positioned below and secured to the receptacle, the receptacle of the holder being of open network construction to expose said block to atmosphere, a buoyant member of porous sponge-like water insoluble material having such buoyancy as to float in a body of water in the urinal or the like and to support on the water said block in said holder, and securing means for securing the flat base of the holder on the buoyant member and supporting the holder and block substantially at and above the surface of the water to limit dissolution of the block by the water in the urinal or the like.

5. The combination as claimed in claim 4 and in which said securing means is a water insoluble adhesive bonding the bottom of the flat base of the holder to the top of the buoyant member to support the holder and block above the buoyant member.

6. Means for supporting a block of water soluble deodorant or the like substantially above the surface of a body of water located in the bottom portion of a receptacle or the like to limit dissolution of the block in said body of water, said means comprising the combination of a holder having an open network construction of plastic or the like for enclosing said block and exposing the block through the interstices of said open network construction, said holder having a relatively broad base portion and a central portion above the base portion intermediate the outer limits of the base portion for accommodating said block therein, and a buoyant member positioned below the base portion of the holder and bottom of said base portion of the holder for supporting the holder and block of said body of water with the block in said central portion held substantially out of contact with the body of water below to limit the dissolution of the block by the said body of water.

7. Means as claimed in claim 6 and in which said buoyant member is made of expanded plastics of the group made up of polystyrene, polyethylene, and polyurethene, and is generally congruent in lateral shape and size with the lateral shape and size to that of said base.

8. Means as claimed in claim 7 and in which the buoyant member and base portion are secured together by a water insoluble adhesive sandwiched between them.

* * * * *